US010627741B2

(12) United States Patent
Yokoyama

(10) Patent No.: US 10,627,741 B2
(45) Date of Patent: Apr. 21, 2020

(54) IMAGE FORMING APPARATUS

(71) Applicant: KYOCERA Document Solutions Inc., Osaka (JP)

(72) Inventor: Yoshiki Yokoyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/393,197

(22) Filed: Apr. 24, 2019

(65) Prior Publication Data

US 2019/0332031 A1 Oct. 31, 2019

(30) Foreign Application Priority Data

Apr. 25, 2018 (JP) ..... 2018-083618

(51) Int. Cl.
*G03G 15/08* (2006.01)

(52) U.S. Cl.
CPC ..... *G03G 15/0856* (2013.01); *G03G 15/0867* (2013.01)

(58) Field of Classification Search
CPC ..... G04G 21/1633; G03G 2215/0665; G03G 15/0867; G03G 15/0856
See application file for complete search history.

(56) References Cited

U.S. PATENT DOCUMENTS 3,728,017 A * 4/1973 Schmidlin ..... G03G 15/28 355/18
4,191,433 A * 3/1980 Rampp ..... B41J 29/12 312/183
2010/0226683 A1* 9/2010 Yamaguchi ..... G03G 21/1633 399/110
2017/0272593 A1* 9/2017 Kamiya ..... G03G 15/5016

FOREIGN PATENT DOCUMENTS

JP 2018-40954 3/2018

* cited by examiner

*Primary Examiner* — Gregory H Curran
(74) *Attorney, Agent, or Firm* — Wenderoth, Lind & Ponack, L.L.P.

(57) ABSTRACT

An image forming apparatus includes a body casing provided therein with a container mounting part in which a plurality of toner containers are juxtaposed and mounted in a predetermined direction and an opening and closing door for opening and closing a toner container attaching/detaching opening formed on a sidewall opposite to the container mounting part in the body casing. The opening and closing door includes a plurality of sliding doors configured to slidably move within a range of a width of the opening in the predetermined direction.

5 Claims, 7 Drawing Sheets

(C)

IMAGE FORMING APPARATUS

CROSS-REFERENCE TO RELATED APPLICATION

This application is based upon and claims the benefit of priority from Japanese Patent Application No. 2018-083618 filed on Apr. 25, 2018, the entire contents of which are incorporated herein by reference.

BACKGROUND

The technology of the present disclosure relates to an image forming apparatus.

In general, in an electrophotographic color image forming apparatus, four toner containers storing toners of respective colors (yellow, cyan, magenta, and black) are replaceably mounted.

The four toner containers are juxtaposed in a mounting space within an image forming apparatus body in the right and left direction. The image forming apparatus body is formed on the side surface thereof with an opening for attaching/detaching (replacing) the toner containers. The opening is provided with an opening and closing door, and the opening and closing door opens and closes the opening by rotating around a support shaft extending in the vertical direction.

SUMMARY

An image forming apparatus according to one aspect of the present disclosure includes a body casing and an opening and closing door. The body casing is provided therein with a container mounting part in which a plurality of toner containers are juxtaposed and mounted in a predetermined direction. The opening and closing door opens and closes a toner container attaching/detaching opening formed on a sidewall opposite to the container mounting part in the body casing.

The opening and closing door includes a plurality of sliding doors configured to slidably move within a range of a width of the opening in the predetermined direction.

DETAILED DESCRIPTION

Hereinafter, an example of an embodiment according to the technology of the present disclosure will be described in detail on the basis of the drawings. It is noted that the technology of the present disclosure is not limited to the following embodiments.

Embodiment 1

Figure 1:
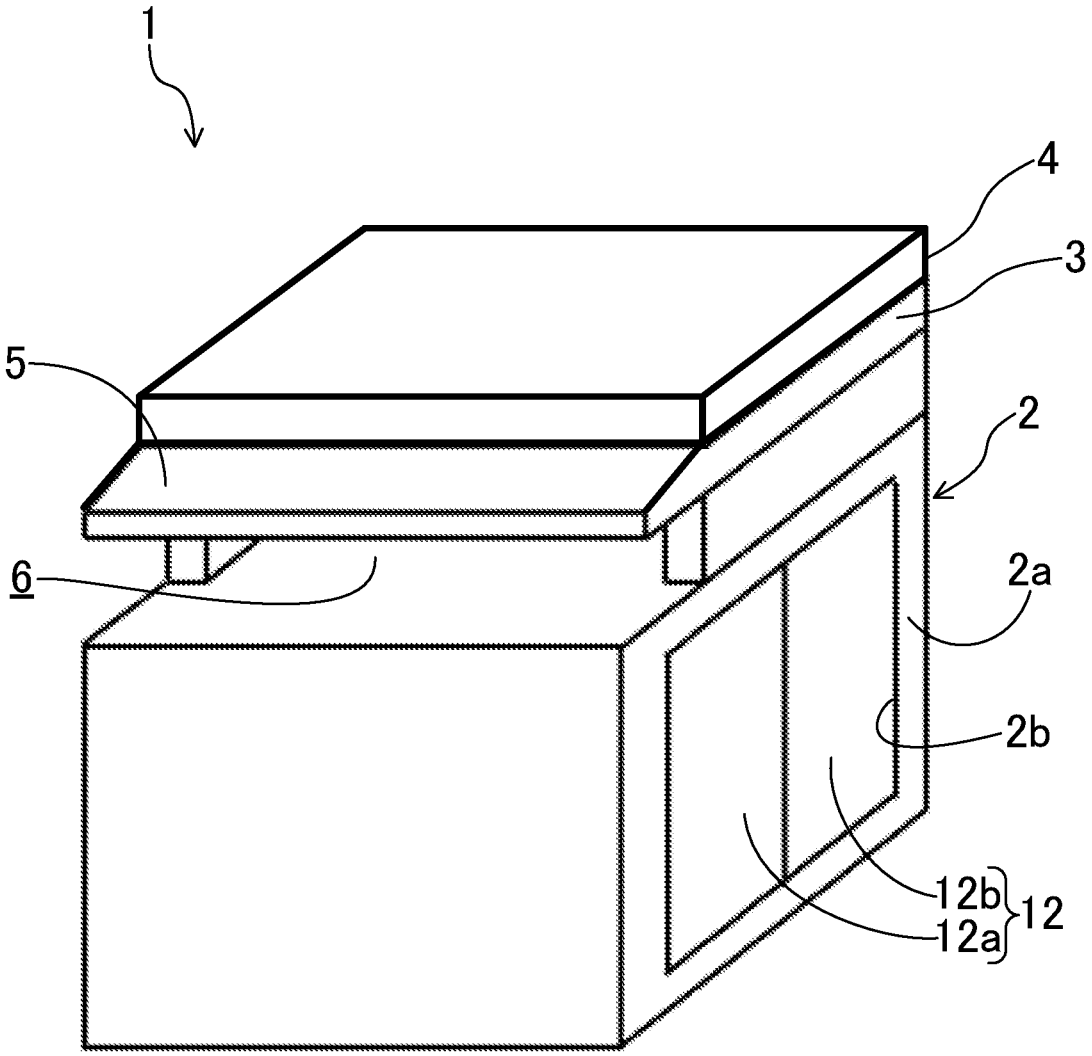
FIG. 1 is an external appearance perspective view illustrating an image forming apparatus in an embodiment 1.
Figure 2:
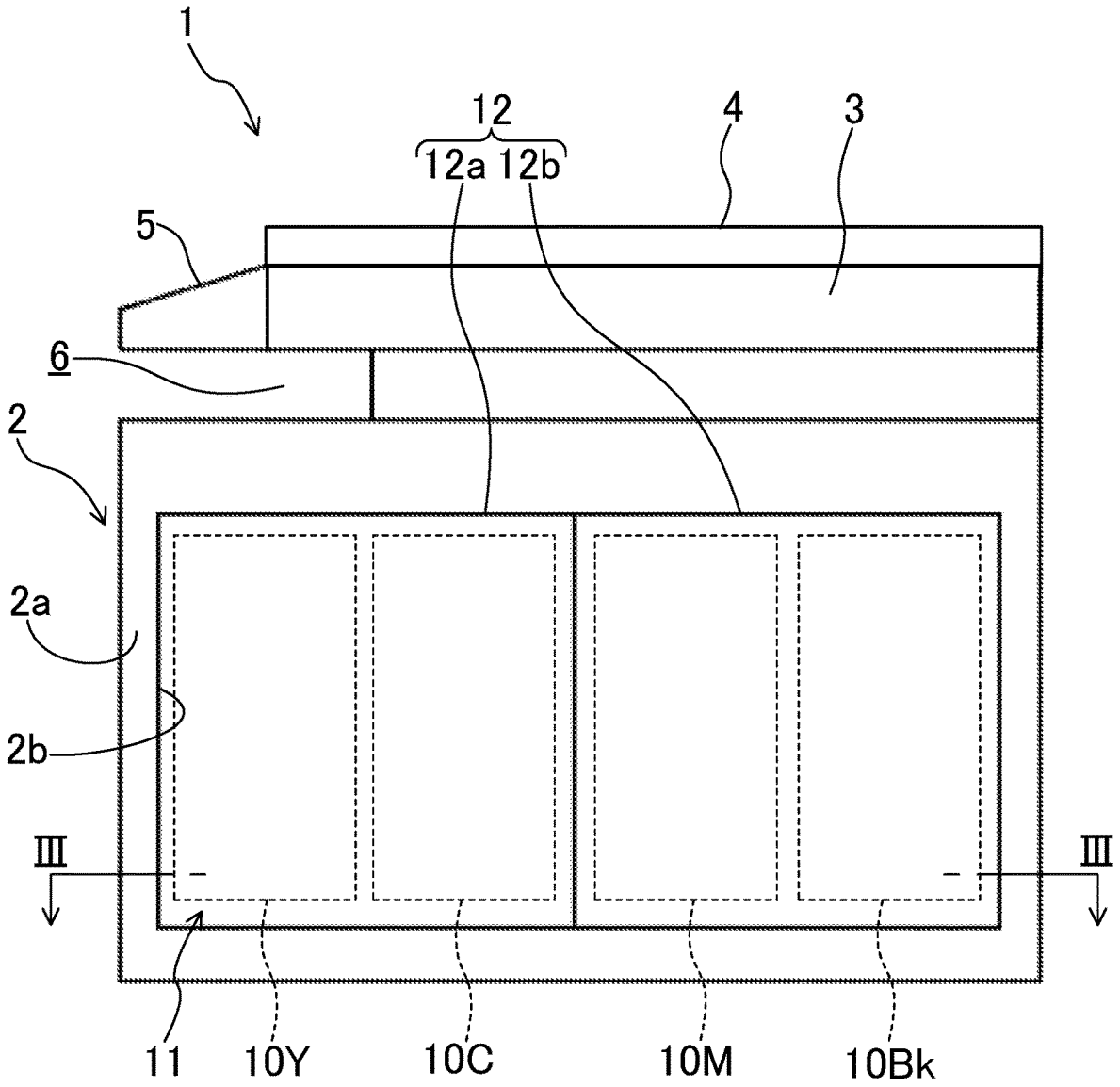
FIG. 2 is a schematic side view when the image forming apparatus in the embodiment 1 is viewed from a right side.

FIG. 1 and FIG. 2 illustrate an image forming apparatus 1 according to an example of an embodiment. FIG. 1 is an external appearance perspective view of the image forming apparatus 1 and FIG. 2 is a right side view of the image forming apparatus 1. In the present embodiment, the image forming apparatus 1 is assumed to be an in-body sheet discharge type color copy machine.

The image forming apparatus 1 includes a rectangular parallelepiped-like body casing 2, an image reading device 3 disposed above the body casing 2, and a document pressing cover 4 that covers an upper surface of the image reading device 3—to be openable and closable.

The body casing 2 forms an image by an electrophotographic method on a sheet supplied from a sheet feeding cassette by using toners of four colors. The sheet with the image formed thereon is conveyed along a predetermined conveyance path in the body casing 2 and then is discharged to an in-body sheet discharge space 6 between the body casing 2 and the image reading device 3.

A contact glass on which a document is placed is mounted on the upper surface of the image reading device 3. The image reading device 3 optically reads an image of the document placed on the contact glass. The document pressing cover 4 opens and closes an upper surface of the contact glass by rotating around a support shaft provided at a rear end of the image reading device 3. The image reading device 3 is provided on the front side surface thereof with an operation panel 5 which can be operated by a user. The operation panel 5 is provided with an operation unit including a numeric keypad and a start key, and a display unit including a liquid crystal display and the like.

As illustrated in FIG. 2, the body casing 2 is provided at the right end of the interior thereof with a container mounting part 11 in which four toner containers 10Y, 10C, 10M, and 10Bk are mounted. The toner containers 10Y, 10C, 10M, and 10Bk store toners of yellow (Y), cyan (C), magenta (M), and black (Bk), respectively. In the following description, when it is not possible to specify a color (when no color is specified) among the four toner containers 10Y, 10C, 10M, and 10Bk, the toner containers are simply referred to as a toner container without any reference numeral.

In the body casing 2, a rectangular toner container attaching/detaching opening 2*b* is formed on a right sidewall 2*a* opposite to the container mounting part 11 over the entire front and rear direction of the image forming apparatus 1. The toner container attaching/detaching opening 2*b* is formed to allow the toner containers 10Y, 10C, 10M, and 10Bk to pass therethrough. The toner container attaching/detaching opening 2*b* is opened and closed by an opening and closing door 12.

Figure 3:
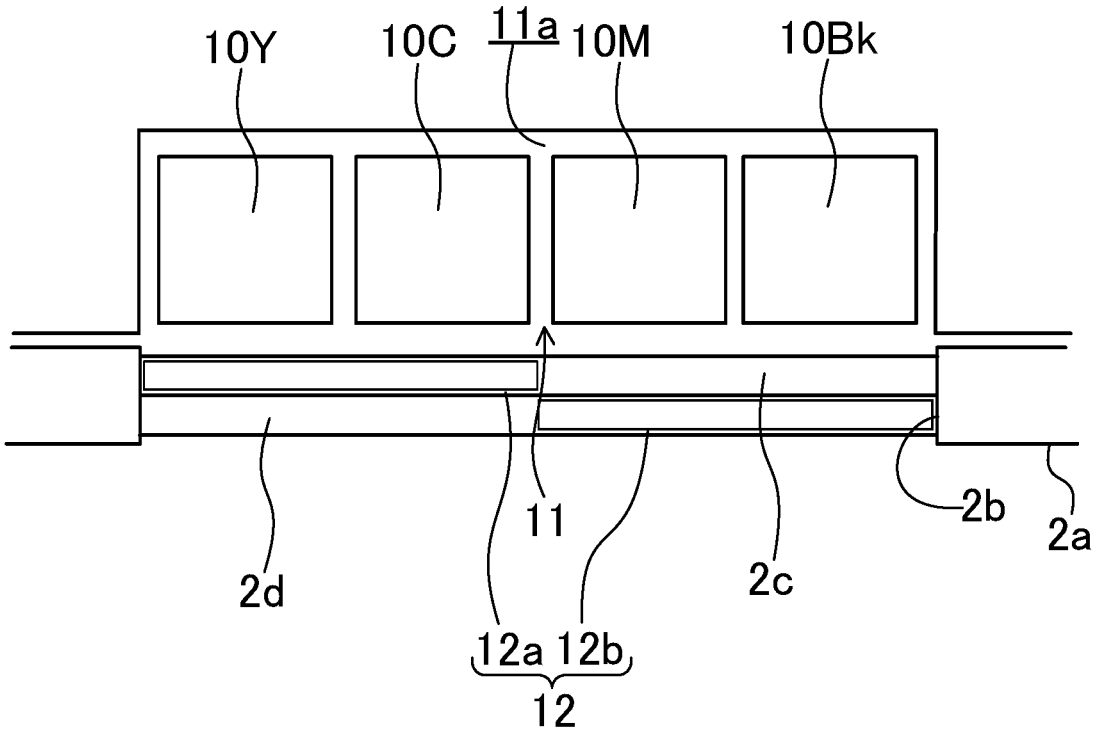
FIG. 3 is a view corresponding to a section taken along line III-III of FIG. 2, which illustrates a schematic structure of an opening and closing door.

As illustrated in FIG. 3, the container mounting part 11 has a rectangular container mounting space 11*a* recessed inwardly of the apparatus body. The four toner containers 10Y, 10C, 10M, and 10Bk are received adjacent to one another within the container mounting space 11*a* in a predetermined direction. In the present embodiment, the predetermined direction is the front and rear direction of the image forming apparatus 1, and is the right and left direction of FIG. 3.

On a bottom wall of the container mounting space 11*a*, a guide rail is formed to guide the toner containers 10Y, 10C, 10M, and 10Bk in the depth direction thereof (the vertical direction of FIG. 3). The toner containers 10Y, 10C, 10M, and 10Bk are mounted to be freely inserted into and pulled out from the container mounting space 11*a* in the depth direction. The widths of the toner containers 10Y, 10C, 10M, and 10Bk are equal to one another.

The toner container attaching/detaching opening 2*b* has a rectangular shape that overlaps an outer edge of the container mounting space 11*a* when viewed from a front side of the container mounting space 11*a* (a right side of the image forming apparatus 1) (see FIG. 2). The width of the toner container attaching/detaching opening 2*b* (the width in the right and left direction of FIG. 2) is slightly larger than the total width of the four toner containers 10Y, 10C, 10M, and 10Bk.

<Configuration of Opening and Closing Door>

The opening and closing door 12 that opens and closes the toner container attaching/detaching opening 2*b* is configured by two sliding doors 12*a* and 12*b* that slide in an opening width direction.

The sliding doors 12*a* and 12*b* are formed in the shape of rectangular plates having the same size. The sliding doors 12*a* and 12*b* serve as a part of an outer cover of the body casing 2 in a fully closed state.

As illustrated in FIG. 3, two rail parts 2*c* and 2*d* are respectively provided on the lower end surface and upper end surface of the toner container attaching/detaching opening 2*b* so as to slidably guide the aforementioned two sliding doors 12*a* and 12*b* in the opening width direction. FIG. 3 illustrates the rail parts 2*c* and 2*d* formed on the lower end surface of the upper and lower end surfaces of the toner container attaching/detaching opening 2*b*.

The aforementioned two rail parts 2*c* and 2*d* are juxtaposed in the depth direction of the toner container attaching/detaching opening 2*b*. Each of the rail parts 2*c* and 2*d*, for example, is configured by a guide groove or a projection bar part extending in the opening width direction.

Furthermore, the first sliding door 12*a* is engaged with the rail part 2*c* on a depth side and the second sliding door 12*b* is engaged with the rail part 2*d* on a front side. The first sliding door 12*a* and the second sliding door 12*b* are configured to be slidable within the range of the width of the toner container attaching/detaching opening 2*b*.

With reference to FIGS. 4A, 4B, 4C, and 4D, an opening and closing state of the toner container attaching/detaching opening 2*b* by the first and second sliding doors 12*a* and 12*b* will be described. In FIGS. 4A, 4B, 4C, and 4D, the rail parts 2*c* and 2*d* are not illustrated in consideration of the easiness to see.

Figure 4A:
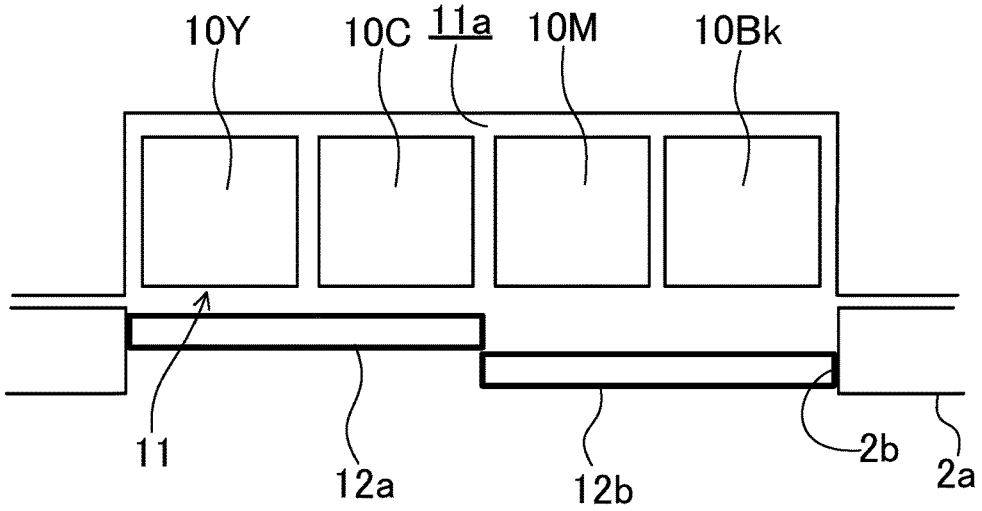
FIG. 4A is an explanation view for explaining an opening and closing state of the opening and closing door.

FIG. 4A illustrates a fully closed state in which the entire toner container attaching/detaching opening 2*b* is closed by both sliding doors 12*a* and 12*b*. In such a state, a left end surface of the first sliding door 12*a* abuts one side end surface in a width direction of the toner container attaching/detaching opening 2*b*, and a right end surface of the second sliding door 12*b* abuts the other side end surface in the width direction of the toner container attaching/detaching opening 2*b*. Furthermore, the first sliding door 12*a* covers the yellow and cyan toner containers 10Y and 10C from the front side, and the second sliding door 12*b* covers the magenta and black toner containers 10M and 10Bk from the front side.

Figure 4B:
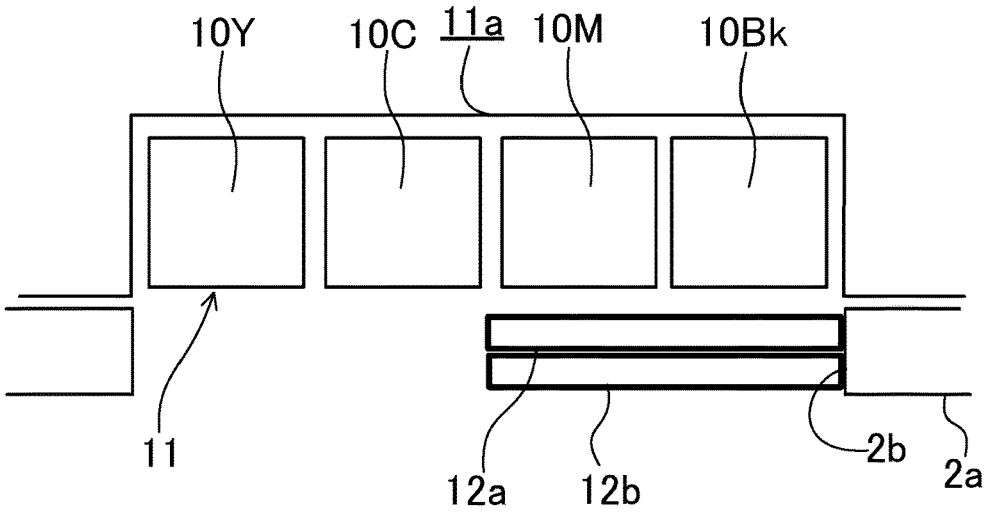
FIG. 4B is an explanation view for explaining an opening and closing state of the opening and closing door.
Figure 4C:
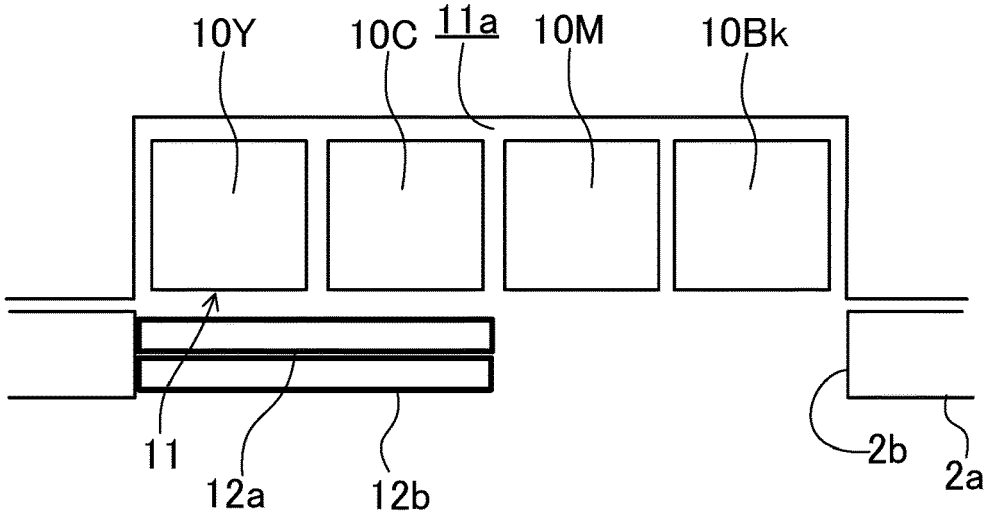
FIG. 4C is an explanation view for explaining an opening and closing state of the opening and closing door.

When the first sliding door 12*a* is slid from the state of FIG. 4A to the right side of the drawing, the yellow and cyan toner containers 10Y and 10C are replaceably exposed to an exterior through the second sliding door 12*b* as illustrated in FIG. 4B. On the other hand, when the second sliding door 12*b* is slid from the state of FIG. 4A to the left side of the drawing, the magenta and black toner containers 10M and 10Bk are replaceably exposed to an exterior as illustrated in FIG. 4C.

As described above, according to the present embodiment, the opening and closing door 12 is configured by the two (the plurality of) sliding doors 12*a* and 12*b* configured to slidably move within the range of the width of the toner container attaching/detaching opening 2*b*.

According to such a configuration, it is not necessary to ensure a passage space (rotation space) of the opening and closing door 12 in addition to an installation space of the body casing 2 as in the case where the opening and closing door 12 is configured by a rotary opening and closing door. Thus, it is possible to improve space efficiency of an indoor where the image forming apparatus 1 is installed.

Furthermore, since the movement range of the two sliding doors 12*a* and 12*b* is limited within the range of the width of the toner container attaching/detaching opening 2*b*, the two sliding doors 12*a* and 12*b* are not movable outward in the opening width direction of the toner container attaching/detaching opening 2*b*. Consequently, the rail parts 2*c* and 2*d* need not to extend outward in the opening width direction of the toner container attaching/detaching opening 2*b*. Thus, it is possible miniaturize the body casing 2.

Embodiment 2

Figure 5:
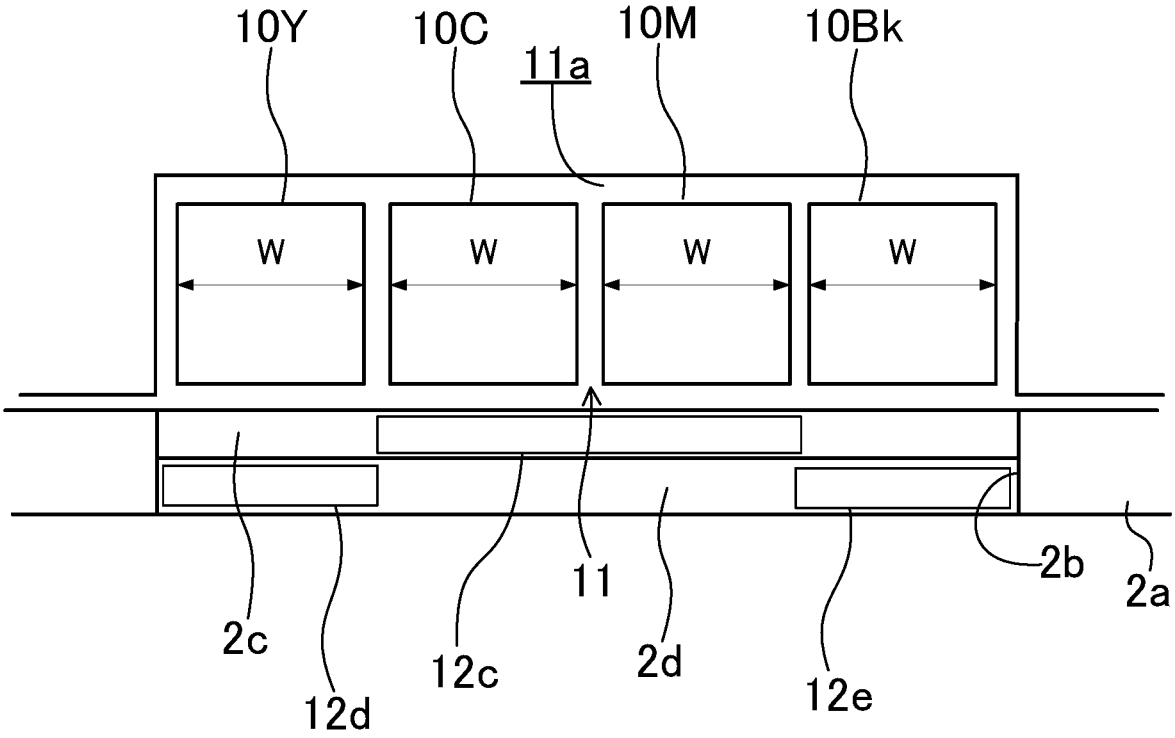
FIG. 5 is a view corresponding to FIG. 3 in an embodiment 2.
Figure 6A:
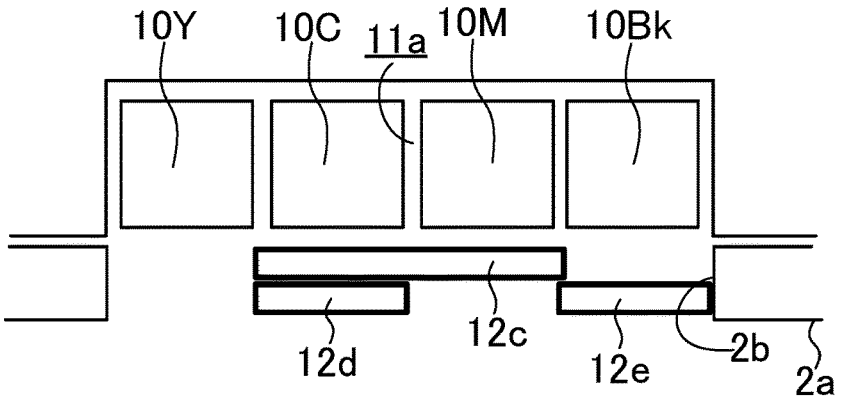
FIG. 6A is an explanation view for explaining a partially opened state of an opening and closing door in the embodiment 2.
Figure 6B:
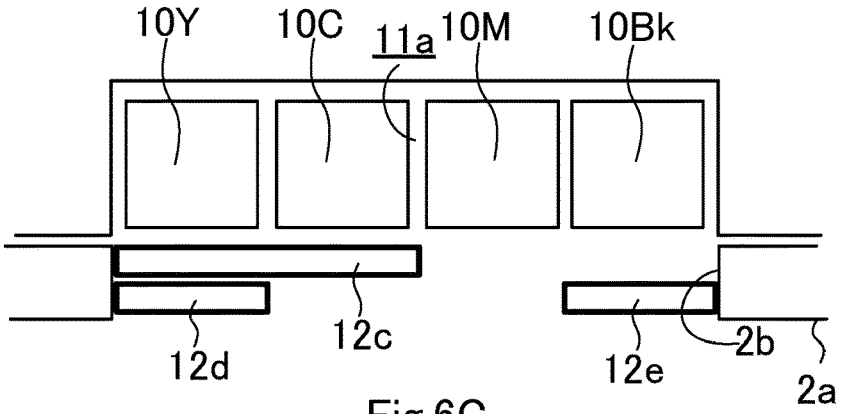
FIG. 6B is an explanation view for explaining a partially opened state of an opening and closing door in the embodiment 2.
Figure 6C:
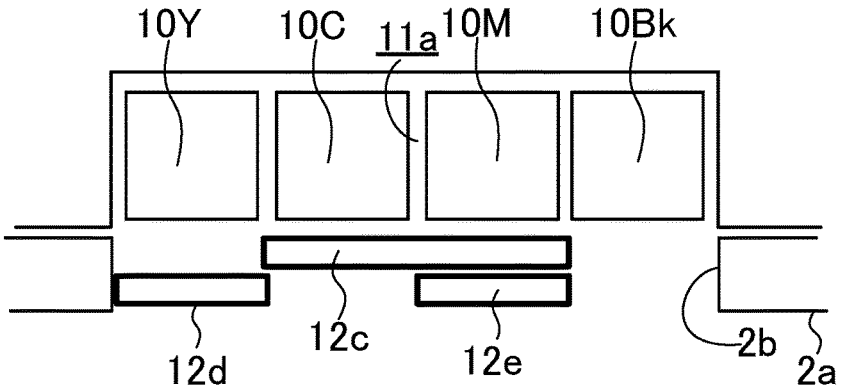
FIG. 6C is an explanation view for explaining a partially opened state of an opening and closing door in the embodiment 2.
Figure 6D:
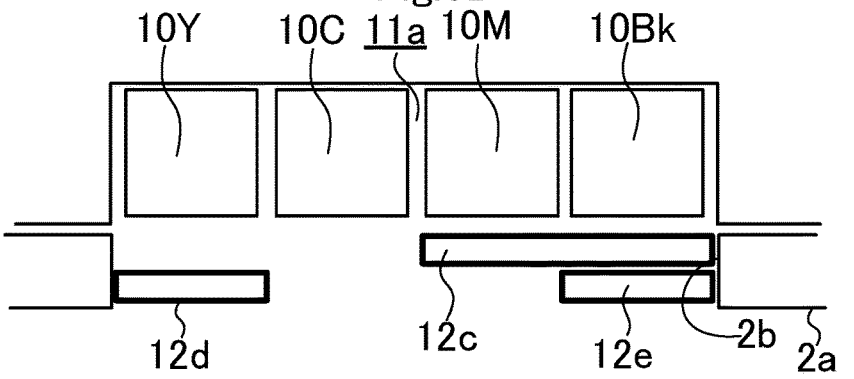
FIG. 6D is an explanation view for explaining a partially opened state of an opening and closing door in the embodiment 2.
Figure 7:
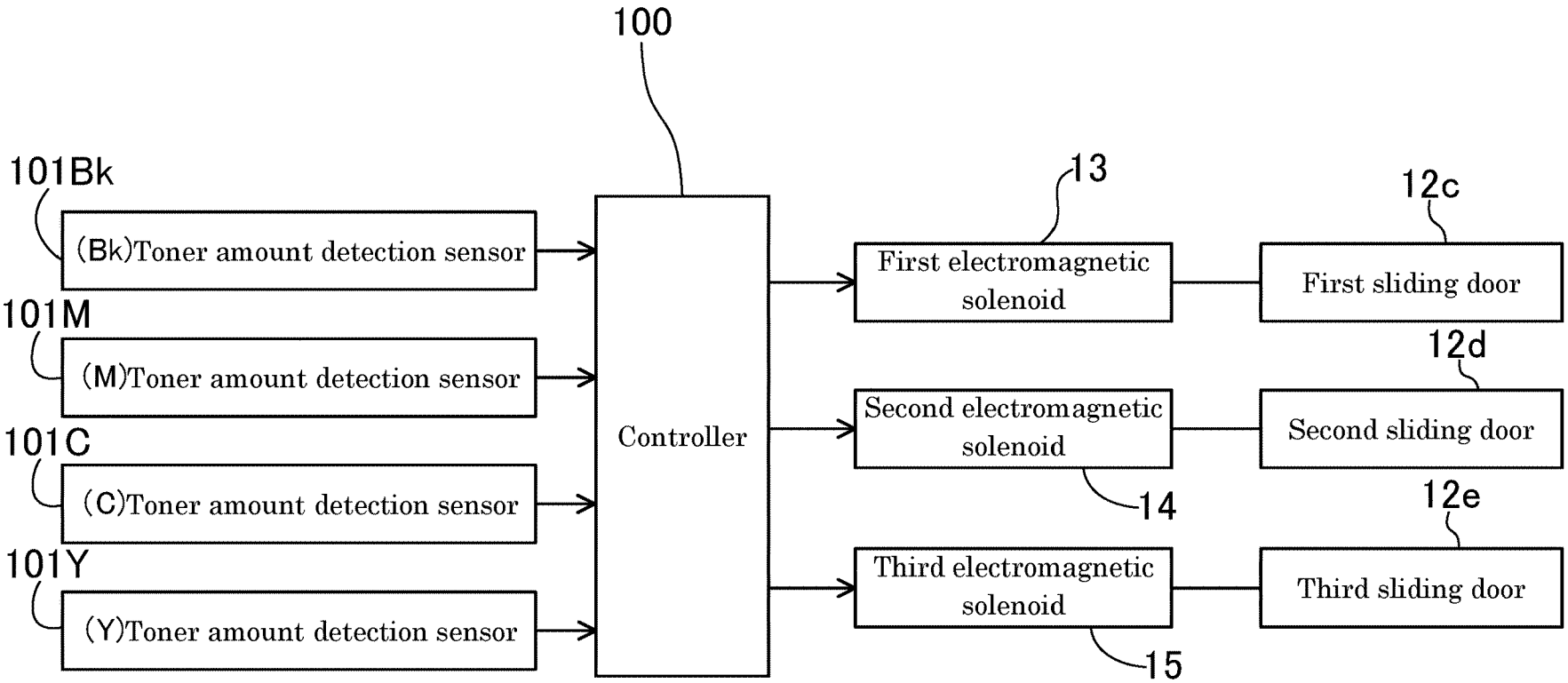
FIG. 7 is a block diagram illustrating a control configuration of a driving unit of the opening and closing door in the embodiment 2.

FIG. 5 to FIG. 7 illustrate an embodiment 2. The embodiment 2 is different from the aforementioned embodiment in terms of the number of sliding doors constituting the opening and closing door 12 and a driving method.

That is, in the present embodiment 2, the opening and closing door 12 is configured by first to third sliding doors 12*c* to 12*e*. Furthermore, the sliding doors 12*c* to 12*e* are not manually opened and closed and are driven by first to third electric actuators 13 to 15 (illustrated only in FIG. 7).

Firstly, with reference to FIG. 5, a detailed configuration of the opening and closing door 12 will be described. FIG. 5 illustrates a fully closed state of the opening and closing door 12. The first sliding door 12*c* is engaged with the rail part 2*c* on the depth side. The second sliding door 12*d* and the third sliding door 12*e* are engaged with the rail part 2*d* on the front side. The width of the first sliding door 12*c* is equal to or slightly larger than the widths (=2×W) of two of the toner containers 10Y, 10C, 10M, and 10Bk. The width of each of the second sliding door 12*d* and the third sliding door 12*e* is slightly larger than the width (=W) of one of the toner containers 10Y, 10C, 10M, and 10Bk. In the fully closed state of the aforementioned opening and closing door 12, the first sliding door 12*c* is located at the center in the opening width direction of the toner container attaching/detaching opening 2*b*. The second sliding door 12*d* and the third sliding door 12*e* are located symmetrically with respect to the first sliding door 12*c* in the opening width direction.

The opening and closing door 12 is switched from the fully closed state to a partially opened state, in which only one of the toner containers 10Y, 10C, 10M, and 10Bk is exposed, by changing the position of any one of the three sliding doors 12*c* to 12*e*.

With reference to FIG. 6A to FIG. 6D, the partially opened state will be described. In FIG. 6A to FIG. 6D, the rail parts 2*c* and 2*d* are not illustrated in consideration of the easiness to see.

FIG. 6A illustrates a first partially opened state in which only the yellow toner container 10Y of the four toner containers 10Y, 10C, 10M, and 10Bk is exposed to an exterior from the toner container attaching/detaching opening 2*b*. The first partially opened state is achieved by moving the second sliding door 12*d* from the fully closed state illustrated in FIG. 5 to the right side of the drawing by the same amount as the door width.

FIG. 6B illustrates a second partially opened state in which only the magenta toner container 10M of the four toner containers 10Y, 10C, 10M, and 10Bk is exposed to an exterior from the toner container attaching/detaching opening 2*b*. The second partially opened state is achieved by moving the first sliding door 12*c* from the fully closed state illustrated in FIG. 5 to the left side of the drawing by half of the door width.

FIG. 6C illustrates a third partially opened state in which only the black toner container 10Bk of the four toner containers 10Y, 10C, 10M, and 10Bk is exposed to an exterior from the toner container attaching/detaching opening 2*b*. The third partially opened state is achieved by moving the third sliding door 12*e* from the fully closed state illustrated in FIG. 5 to the left side of the drawing by the same amount as the door width.

FIG. 6D illustrates a fourth partially opened state in which only the cyan toner container 10C of the four toner containers 10Y, 10C, 10M, and 10Bk is exposed to an exterior from the toner container attaching/detaching opening 2*b*. The fourth partially opened state is achieved by moving the first sliding door 12*c* from the fully closed state illustrated in FIG. 5 to the right side of the drawing by half of the door width.

The first to third sliding doors 12*c* to 12*e* constituting the opening and closing door 12 are driven by the first to third electric actuators 13 to 15 (illustrated only in FIG. 7), respectively. Each of the first to third electric actuators 13 to 15, for example, is configured by an electromagnetic solenoid mounted on an inner surface of the right sidewall 2*a* of the body casing 2.

As illustrated in FIG. 7, the first to third electric actuators 13 to 15 are connected to a controller 100 via signal lines. The controller 100 is configured by a microcomputer having a CPU, a ROM, and a RAM. The controller 100 is further connected with four toner amount detection sensors 101Y, 101C, 101M, and 101Bk (an example of a toner remaining amount detection unit) via signal lines.

The toner amount detection sensors 101Y, 101C, 101M, and 101Bk detect toner remaining amounts in the toner containers 10Y, 10C, 10M, and 10Bk of the respective colors, respectively, and transmit signals (information) corresponding to the remaining amounts to the controller 100. Each of the toner amount detection sensors 101Y, 101C, 101M, and 101Bk may be a sensor that detects only the absence of a toner. In this way, the toner amount detection sensors 101Y, 101C, 101M, and 101Bk serve as toner remaining amount detection units capable of detecting the absence of the toners in the toner containers 10Y, 10C, 10M, and 10Bk of the respective colors.

The controller 100 specifies a toner container with no toner based on the signal from each of the toner amount detection sensors 101Y, 101C, 101M, and 101Bk, and specifies a partially opened state (the state of any one of FIG. 6A to FIG. 6D) for exposing the specified toner container to an exterior from the toner container attaching/detaching opening 2*b*. Then, the controller 100 controls the positions of the first to third sliding doors 12*c* to 12*e* via the first to third electric actuators 13 to 15 so as to achieve the specified partially opened state. In this way, the controller 100 serves as a door position control unit.

When a plurality of toner containers detected to have no toner exist in the aforementioned four toner containers 10Y, 10C, 10M, and 10Bk, it is sufficient if the positions of the first to third sliding doors 12*c* to 12*e* (driving position of the first to third electric actuators 13 to 15) are controlled such that the plurality of toner containers are sequentially exposed to an exterior one by one. In such a case, whenever replacement of one of the plurality of toner containers detected to have no toner is completed, the controller 100 changes the opened states of the first to third sliding doors 12*c* to 12*e* such that a next toner container can be replaced. Determination regarding whether the replacement of the toner containers 10Y, 10C, 10M, and 10Bk has been completed, for example, can be performed by determining whether the detection state of each of the toner amount detection sensors 101Y, 101C, 101M, and 101Bk is switched from the absence of a toner to the presence of a toner (more than a predetermined amount by which printing is possible).

As described above, in the present embodiment, the aforementioned two sliding doors 12*a* and 12*b* are configured to be able to be switchable between the fully closed state, in which the entire toner container attaching/detaching opening 2*b* is closed, and the partially opened state, in which only one of the toner containers 10Y, 10C, 10M, and 10Bk is exposed to an exterior from the toner container attaching/detaching opening 2*b*, in cooperation with each other. Furthermore, the controller 100 controls the positions of the first to third sliding doors 12*c* to 12*e* such that only a toner container of the four toner containers 10Y, 10C, 10M, and 10Bk, which is detected to have no toner by the toner amount detection sensors 101Y, 101C, 101M, and 101Bk, is exposed to an exterior.

Consequently, a user can simply take out and replace a toner container exposed to an exterior from the toner container attaching/detaching opening 2*b* without selecting a toner container detected to have no toner by his/her judgment, thereby completing the replacement of the toner containers 10Y, 10C, 10M, and 10Bk. Thus, it is possible to easily replace the toner containers 10Y, 10C, 10M, and 10Bk.

Other Embodiments

In the aforementioned embodiments, the image forming apparatus 1 is assumed to be an in-body sheet discharge type color copy machine; however, the present disclosure is not limited thereto. That is, in the present embodiment, the image forming apparatus 1 is not limited to a copy machine and may include a facsimile, a printer, a multifunctional peripheral (MFP) and the like.

The aforementioned embodiments have described an example in which the opening and closing door 12 is configured by the two sliding doors 12*a* and 12*b* and an example in which the opening and closing door 12 is configured by the three sliding doors 12*c* to 12*e*; however, the present disclosure is not limited thereto. That is, the opening and closing door 12 may be configured by four or more sliding doors. Also, the number of the rail parts 2*c* and 2*d* is not limited to 2 and may be 3 or more.

What is claimed is:

1. An image forming apparatus comprising:

a body casing provided therein with a container mounting part in which a plurality of toner containers are juxtaposed and mounted in a predetermined direction; and an opening and closing door for opening and closing a toner container attaching/detaching opening formed on a sidewall opposite to the container mounting part in the body casing, wherein the opening and closing door includes:

a plurality of sliding doors configured to be slidably movable within a range of a width of the opening in the predetermined direction, the plurality of sliding doors being configured to be switchable between a state, in which the opening is fully closed, and a state, in which only one of the toner containers is exposed to an exterior from the opening, in cooperation with each other, the plurality of toner containers store toners of different colors, and the image forming apparatus further comprises:

a toner remaining amount detection unit that is able to detect that the toner of each of the toner containers is exhausted; and a door position control unit that specifies a toner container with no toner based on information from the toner remaining amount detection unit, and controls positions of the plurality of sliding doors such that only the toner container is exposed to the exterior from the opening.

2. The image forming apparatus of claim 1, wherein, when a plurality of toner containers detected to have no toner exist in the plurality of toner containers, the door position control unit is configured to control the positions of the plurality of sliding doors such that the plurality of toner containers detected to have no toner are sequentially exposed one by one to the exterior from the opening.

3. An image forming apparatus comprising:

a body casing provided therein with a container mounting part in which four toner containers are juxtaposed and mounted in a predetermined direction; and an opening and closing door for opening and closing a toner container attaching/detaching opening formed on a sidewall opposite to the container mounting part in the body casing, wherein the opening and closing door includes:

a plurality of sliding doors configured to be slidably movable within a range of a width of the opening in the predetermined direction, wherein the plurality of sliding doors, in a fully closed state in which the entire opening is closed, include a first sliding door covering two of the four toner containers on a central side in the predetermined direction, a second sliding door covering one of the four toner containers on a first end side in the predetermined direction, and a third sliding door covering one of the four toner containers on a second end side in the predetermined direction, and the plurality of sliding doors are switched from the fully closed state, any one of the four toner containers being configured to be exposable from the opening to an exterior by changing a position of one sliding door of the first to the third sliding doors.

4. The image forming apparatus of claim 3, wherein the four toner containers store toners of different colors, and the image forming apparatus further comprises:

a toner remaining amount detection unit that is able to detect that the toner of each of the toner containers is exhausted; and a door position control unit that specifies a toner container with no toner based on information from the toner remaining amount detection unit, and controls positions of the first to third sliding doors such that only the toner container is exposed to the exterior from the opening.

5. The image forming apparatus of claim 4, wherein, when a plurality of toner containers detected to have no toner exist in the four toner containers, the door position control unit is configured to control the positions of the plurality of sliding doors such that the plurality of toner containers are sequentially exposed one by one to the exterior from the opening.

* * * * *